US011047630B2

(12) United States Patent
Rasmussen

(10) Patent No.: US 11,047,630 B2
(45) Date of Patent: Jun. 29, 2021

(54) FUSER ASSEMBLIES

(71) Applicant: Hewlett-Packard Development Company, L.P., Spring, TX (US)

(72) Inventor: Steve O Rasmussen, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/713,998

(22) Filed: Dec. 13, 2019

(65) Prior Publication Data

US 2020/0116441 A1 Apr. 16, 2020

Related U.S. Application Data

(63) Continuation of application No. 15/775,999, filed on May 14, 2018, now Pat. No. 10,539,376.

(51) Int. Cl.

| | |
|---|---|
| ***F28F 5/02*** | (2006.01) |
| ***B41J 13/076*** | (2006.01) |
| ***B41J 2/435*** | (2006.01) |
| ***B41J 2/455*** | (2006.01) |
| ***B41J 11/00*** | (2006.01) |

(52) U.S. Cl.

CPC ..... *F28F 5/02* (2013.01); *B41J 2/435* (2013.01); *B41J 2/455* (2013.01); *B41J 11/002* (2013.01); *B41J 13/076* (2013.01)

(58) Field of Classification Search

CPC ... G03G 2215/2035; G03G 2215/2016; G03G 15/2042; G03G 15/2053; G03G 15/2039; B41J 11/002

See application file for complete search history.

(56) References Cited

U.S. PATENT DOCUMENTS

| | | | | |
|---|---|---|---|---|
| 5,450,182 | A | 9/1995 | Wayman | |
| 6,469,279 | B1 | 10/2002 | Ohtsuka | |
| 6,775,509 | B2 * | 8/2004 | Shida | G03G 15/2053 219/216 |
| 6,818,290 | B1 * | 11/2004 | Chopra | G03G 15/2057 399/320 |
| 6,898,410 | B2 | 5/2005 | Boss | |
| 7,358,271 | B2 | 4/2008 | Nishi | |
| 7,538,299 | B2 | 5/2009 | Spence et al. | |
| 8,231,196 | B2 | 7/2012 | Lang | |
| 8,635,761 | B2 | 1/2014 | Wu | |
| 8,899,738 | B2 | 12/2014 | LeFevre et al. | |
| 2003/0077092 | A1 * | 4/2003 | Ogawa | G03G 15/2064 399/328 |

(Continued)

FOREIGN PATENT DOCUMENTS

| | | |
|---|---|---|
| JP | 2010-244043 | 10/2010 |
| WO | WO-2012083000 | 6/2012 |

OTHER PUBLICATIONS

Webpage~~Image Specialists ~ "How Inkjet Printer Work ~ Ink Intelligence" ~ Feb. 19, 2016 ~ 6 pages.

*Primary Examiner* — John Zimmermann

(74) *Attorney, Agent, or Firm* — Dicke Billig & Czaja PLLC

(57) ABSTRACT

Some examples include a fuser assembly to operate with a roller including a fuser housing, and an array of fusers disposed in the fuser housing, each fuser including a heating element exposed along a surface of the fuser housing and adjacent to an outer surface of the roller.

19 Claims, 5 Drawing Sheets

(56) References Cited

U.S. PATENT DOCUMENTS

| | | | | |
|---|---|---|---|---|
| 2004/0218950 | A1 | 11/2004 | Gogate et al. | |
| 2004/0227802 | A1 | 11/2004 | Liaw | |
| 2006/0067754 | A1* | 3/2006 | Gilmore | G03G 15/2057 399/333 |
| 2006/0067757 | A1 | 3/2006 | Anderson | |
| 2006/0133867 | A1 | 6/2006 | Coleman et al. | |
| 2007/0065191 | A1* | 3/2007 | Iwasaki | G03G 15/2028 399/328 |
| 2007/0120933 | A1 | 5/2007 | Mueller | |
| 2010/0086324 | A1 | 4/2010 | Smith | |
| 2010/0158587 | A1 | 6/2010 | Shin | |
| 2010/0302337 | A1* | 12/2010 | Zhou | G03G 15/2014 347/200 |
| 2013/0271542 | A1 | 10/2013 | Leighton | |

* cited by examiner

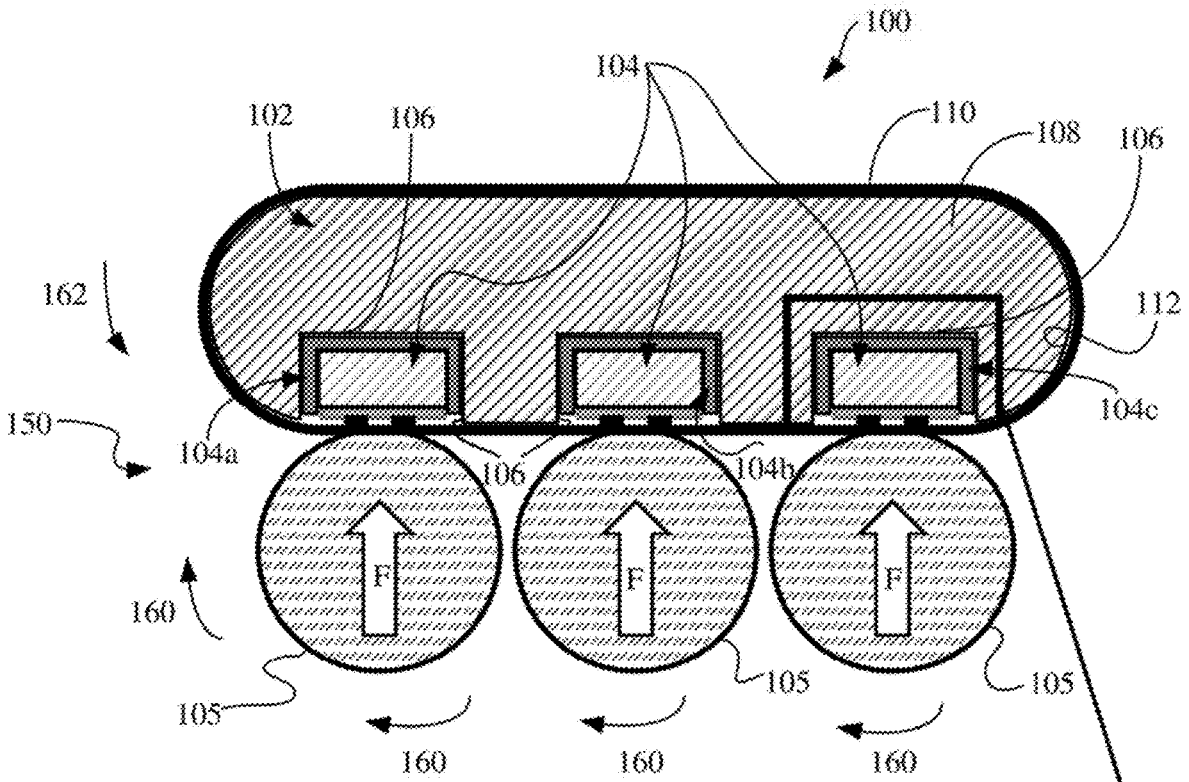
FIG. 2
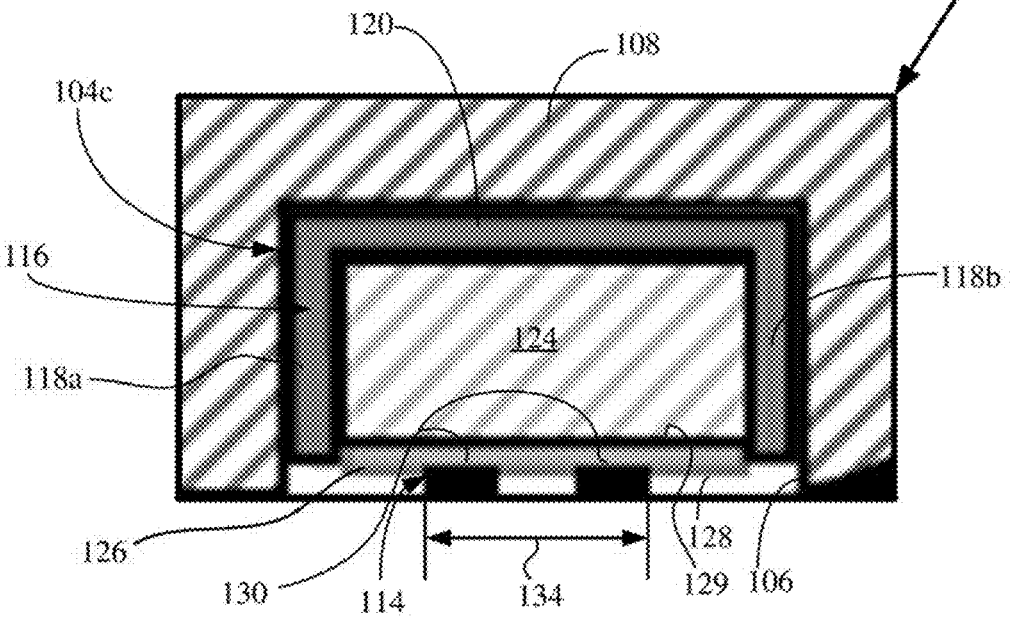
INSET A

FUSER ASSEMBLIES

BACKGROUND

Inkjet printers can deposit quantities of printing fluid onto a printable media (e.g., paper, plastic, etc.). In some examples, inkjet printers can create a curl and/or cockle in the printed media when the printing fluid droplets deposited by the inkjet printer are not completely dry. In some examples, a number of physical properties of the printable media can be changed when the printing fluid droplets deposited by the inkjet printer are not completely dry. For example, the stiffness of the printable media can be changed when the printing fluid droplets deposited by the inkjet printer are not completely dry. The curl, cockle, and/or other physical properties that change due to the printing fluid droplets can make finishing processes difficult.

BRIEF DESCRIPTION OF THE DRAWINGS

FIG. 2 is a schematic cross-sectional diagram of a media conditioner including an example fuser assembly and rollers in accordance with aspects of the present disclosure.

DETAILED DESCRIPTION

In the following detailed description, reference is made to the accompanying drawings which form a part hereof, and in which is shown by way of illustration specific examples in which the disclosure may be practiced. It is to be understood that other examples may be utilized and structural or logical changes may be made without departing from the scope of the present disclosure. The following detailed description, therefore, is not to be taken in a limiting sense, and the scope of the present disclosure is defined by the appended claims. It is to be understood that features of the various examples described herein may be combined, in part or whole, with each other, unless specifically noted otherwise.

Finishing (e.g., aligning, stapling, stacking) of un-dried or partially dried inkjet media output can be difficult. Many finisher devices and methods are not suited for working with partially dried inkjet output as the printed media can be distorted from curl and cockle and/or can have reduced stiffness from increased moisture content, for example. Additionally, the surface roughness increases due to increased moisture when the media is printed upon which, in turn, increases the sheet to sheet friction of the media. A number of systems and devices for partially dried inkjet media fusers are currently available. Forms of drying involving a single fuser are not able to counteract curl and other distorted property of undried or partially dried media and additional forms of drying systems are often employed.

In addition to causing printer damage and/or shutdown, too much heat applied in one location can also adversely affect product quality. In particular, too much moisture may be driven out of the edges of narrower media by the adjoining high heat. When this occurs, excessive media curl or wave, caused by differences in moisture content across the media, develop and produce a product of substandard appearance. In some cases of elevated, focused heat application, scorching or burning of the media can occur.

In accordance with aspects of the present disclosure, a media conditioner including a fuser assembly can be utilized to apply pressure and heat to the undried inkjet media to restore the distorted properties caused by the printing fluid absorbed by the media. The media can be printed on one or both sides. The media conditioner can remove moisture from the media after printing and prior to proceeding to a finishing device. The media conditioner can be connected between the printing device, or printing head, and the finishing device. The media conditioner can be utilized to enhance drying of the printing fluid with pressure and heat across a series of contact zones as described further below.

Figure 1:
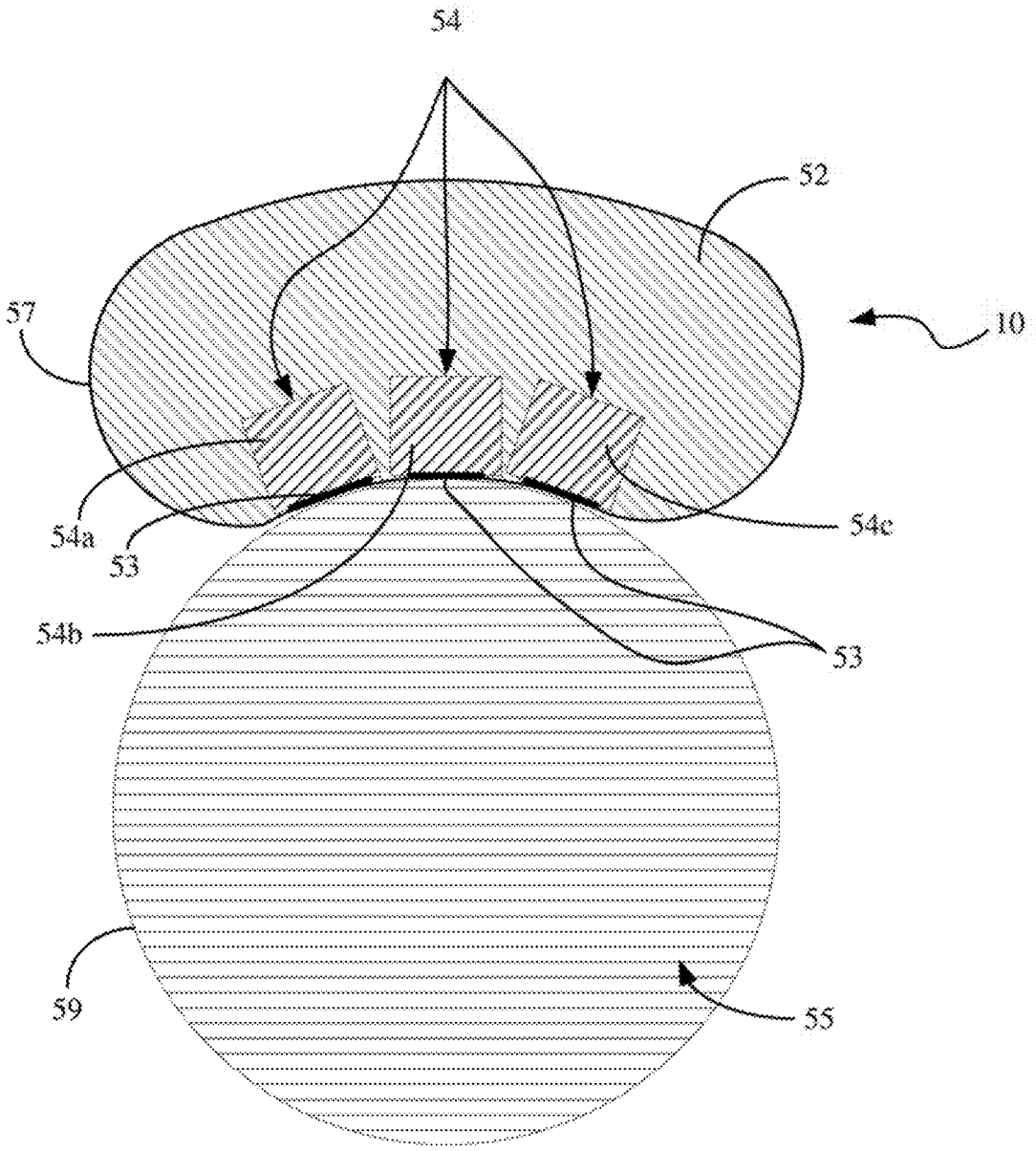
FIG. 1 is a schematic cross-sectional diagram of an example fuser assembly to operate with a roller in accordance with aspects of the present disclosure.

FIG. 1 is a schematic cross-sectional diagram of an example fuser assembly 10 to operate with a roller 55 in accordance with aspects of the present disclosure. Fuser assembly 10 includes a fuser housing 52 and an array of fusers 54 disposed in fuser housing 52. Each fuser 54*a*, 54*b*, 54*c* of array of fusers 54 includes a heating element 53 exposed along a surface 57 of fuser housing 52 and adjacent to an outer surface 59 of roller 55.

FIG. 2 illustrates an example media conditioner 150 including a fuser assembly 100 consistent with the present disclosure. Fuser assembly 100 includes a fuser housing 102 and an array of fusers 104. Array of fusers 104 are disposed, or contained, within openings 106 in a body 108 of fuser housing 102. A belt 110 encircles fuser housing 102. Belt 110 is tubular and encircles an exterior surface 112 of fuser housing 102. Belt 110 is movable along exterior surface 112 of fuser housing 102 and array of fusers 104. Belt 110 has good heat conduction, low thermal mass, and handles forces of compression and friction while traveling through contact zones 134 (described in more detail below). Belt 110 can be formed of a lamination of plastics and/or metal, for example, although other suitable materials are also acceptable.

Fuser housing 102 can be elliptical in cross-section and include array of fusers 104 positioned linearly, as illustrated in FIG. 1. Other appropriate shapes of fuser housing 102 suitable to accommodate positioning each fuser 104*a*, 104*b*, 104*c* of array of fusers 104 against a roller 105 are also acceptable. In one example, fuser housing 102 is formed of a solid plastic, although other materials, including multiple materials and/or non-solid forms, can be employed in fuser housing 102.

In some examples, each or at least one, fuser in array of fusers 104 extends substantially an entire length of fuser housing 102. Array of fusers 104 is operably associated within fuser housing 102, with each fuser 104*a*-104*c* including a heating element 114 exposed at each opening 106 along exterior surface 112 of fuser housing 102. Heating element 114 can be, in some cases, aligned with exterior surface 112 of fuser housing 102.

With additional reference to the enlarged exemplary fuser 104*c* illustrated in Inset A, each fuser 104*a*, 104*b*, 104*c* includes a channel 116, or inverted trough, disposed within opening 106 of fuser housing 102. In one example, channel 116 is formed in as an elongated open sided rectangle, including two opposing sides 118*a*, 118*b* and a bottom 120 extending between the two opposing sides 118*a*, 118*b*. Other suitable shapes of channel 116 can also be employed, such as U-shaped, square, etc. Channel 116 includes an open side 122, for example, opposite bottom 120 having a width substantially equivalent to a width of opening 106 at exterior surface 112 of fuser housing 102. Open side 122 is positioned along exterior surface 112 of fuser housing 102 such that an interior of channel 116 is fluidly open to the exterior. Opposing sides 118*a*, 118*b* terminate flush with or inset into opening 106 of fuser housing 102. Channel 116 provides rigidity and support to each respective fuser 104*a*, 104*b*, 104*c* and maintains respective fuser 104*a*, 104*b*, 104*c* alignment within fuser housing 102. Channel 116 can be constructed of metal, such as sheet metal, or other rigid material, for example.

A mount 124 is provided on the interior of channel 116. Mount 124 can be disposed along bottom 120 of channel 116 and extend fully between opposing sides 118*a*, 118*b*. In one example, mount 124 occupies the entire interior of channel 116. Mount 124 is coupled to channel 116 with an adhesive, mechanical fastener, or other appropriate mechanism. Mount 124 can provide additional support and rigidity to the respective fuser 104*a*, 104*b*, 104*c*. Mount 124 can be formed of a non-conductive material, such as plastic, for example. Substrate 126 is attached to mount 124 along open side 122 of channel 116. Substrate 126 can be formed as a layer having a first major surface 128 and an opposing second major surface 129 opposite first major surface 128. Substrate 126 can be formed of ceramic or other thermally insulative material. Substrate 126 can extend over the entire, or substantially entire, exposed surface of mount 124.

Substrate 126 is attached to mount 124 and heating element 114 is disposed on substrate 126. Heating element 114 is disposed on first major surface 128 of substrate 126. Each fuser in array of fusers 104 can have separately controllable heating elements 114 and can be controlled to deliver a different degree of heat. In one example, each heating element 114 will deliver a graduated higher or lower heat level than delivered to adjacent fusers in array of fusers 104. In another example, each heating element 114 will deliver the same heat level to each fuser in array of fusers 104.

Heating element 114 can include a resistive heat trace 130. In some examples, resistive heat trace 130 extends linearly along a length of fuser 104*a*, 104*b*, 104*c*. In some examples, resistive heat trace 130 is a conductive wire disposed on substrate 128 and extends in two parallel rows along the length of fuser 104*a*, 104*b*, 104*c*. In one example the heat trace wires can be spaced 5 mm to 8 mm apart from one another on the fuser 104*a*, 104*b*, 104*c*. Other spacing of the heat trace wires can be utilized as appropriate for drying the printed media. Additionally, a protective coating (not shown), such as glass, can be disposed over resistive heat trace 130. Regardless, heating elements 114 each define a heat zone such that equal heat is emitted along the substantially the entire length of the respective fuser 104*a*, 104*b*, 104*c* to evenly condition the media across the media's entire width as the media passes between fuser assembly 100 and roller 105.

With continued reference to FIG. 2, fuser assembly 100, and in particular, array of fusers 104 housed therein, are disposed adjacent rollers 105. Array of fusers 104 can be disposed in a spaced apart, parallel arrangement within fuser housing 102. A distance between adjacent fusers (e.g., fuser 104*a* and 104*b*, etc.) is suitable to correspond to a diameter of roller 105 and operational space between adjacent rollers to allow rollers 105 to freely rotate. Rollers 105 are positioned for cooperative interaction with fuser assembly 100 and array of fusers 104 such that contact zones 134 are formed by each respective fuser of array of fusers 104 in cooperation with the associated roller(s) 105 to apply heat and pressure to the media as it passes between fuser assembly 100 and roller 105. Array of fusers 104 can be disposed in a spaced apart, parallel arrangement within fuser housing 102.

Roller 105 and fuser assembly 100 work in cooperative unison to respectively provide thermal energy for drying the media and provide pressure to smooth the media fibers. A force, as indicated by arrow "F", can be applied by each roller 105 toward the associated, respective fuser 104*a*, 104*b*, 104*c*. In one example, force "F" can be independently controlled at each roller. Alternatively, force "F" applies equal pressure at each roller 105. In some examples, force "F" is a normal force applied perpendicularly toward each fuser 104*a*, 104*b*, 104*c*. Regardless, force "F" is evenly applied along a respective roller 105. Rollers 105 can be compressively resilient and deflect as necessary in response to application of force "F" against fusers 104*a*, 104*b*, 104*c* to provide consistent contact between roller 105 and heat element 114 across each respective contact zone 134. In one example, roller 105 has a rigid steel shaft surrounded by a compliant rubber having a smooth exterior surface. Roller 105 can be cylindrical and rotatable in a clockwise or counter-clockwise (e.g., first or second direction) to assist in moving the media past fusion assembly 100 and through media conditioner 150. In one example, rollers 105 rotate in a direction indicated by arrow 160 and belt 110 on fuser assembly 100 rotates in a direction indicated by arrow 162. Roller 105 has a length dimension measured along its cylindrical axis. In some examples, roller 105 and fuser housing 102 are substantially the same length.

Although three fusers 104*a*, 104*b*, 104*c* and corresponding rollers 105 are illustrated in FIG. 2, it is understood that more or less can be employed to accomplish the desired media conditioning. Each fuser of array of fusers 104 is disposed adjacent an outer surface of roller 105. In some examples, fuser assembly 100 can be in contact with rollers 105 when in an operating state and/or in a non-operating state.

Figure 3:
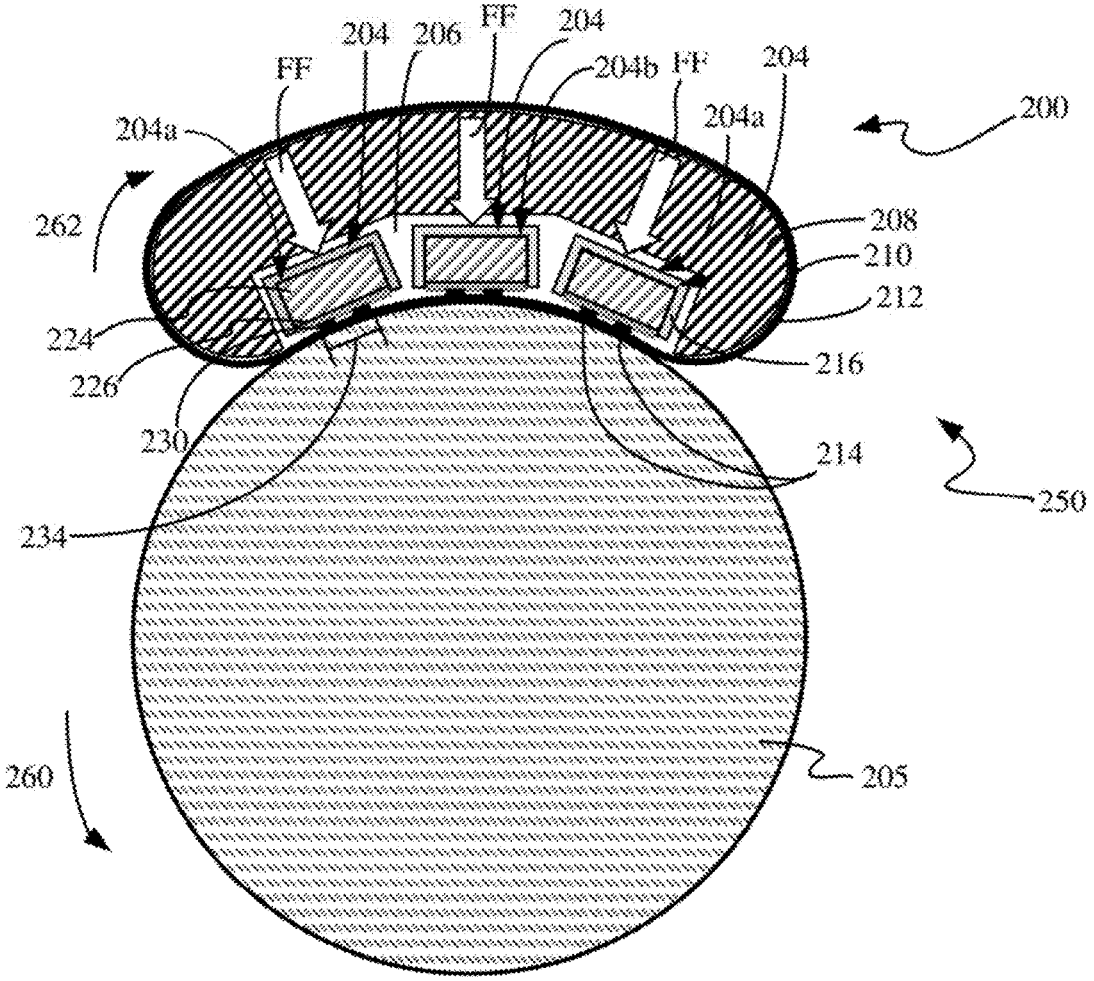
FIG. 3 is a schematic cross-sectional diagram of a media conditioner including another example fuser assembly and a roller in accordance with aspects of the present disclosure.

FIG. 3 illustrates another example of media conditioner 250 including a fusion assembly 200 in accordance with aspects of the present disclosure. Fuser assembly 200 is similar to fuser assembly 100 in many aspects, with like elements numbered similarly. Fuser assembly 200 includes a fuser housing 202 suitable to accommodate an array of fusers 204 arranged along a line of curvature 207 corresponding to a circumference of a roller 205. Fuser housing 202 can be elliptically curved, or kidney-bean shaped, for example, to accommodate roller 205. Fusers in array of fusers 204 are positioned radially with respect to one another along line of curvature 207. Array of fusers 204 can be positioned closely together within a single opening 206 of fuser housing 202. A belt 210 encircles fuser housing 202, extending across opening 206 and array of fusers 204.

Each fuser 204*a*, 204*b*, 204*c* in array of fusers 204 have a heating element 214 exposed along the outer surface of the fuser housing 202. Each fuser 204*a*, 204*b*, 204*c* in array of fusers 204 includes a channel 216, a mount 224, and a substrate 226 upon which heating element 214 is mounted. Heating element 214 includes a resistive heat trace 230 extending along a length of the respective fuser 204*a*, 204*b*, 204*c*.

Roller 205 has a diameter such that fuser assembly 200 can be positioned around at least a portion of an outer surface of roller 205. Although three fusers 204*a*, 204*b*, 204*c* are illustrated in FIG. 2, it is understood that more or less can be employed to accomplish the desired media conditioning. Each fuser of array of fusers 204 is disposed adjacent an outer surface of roller 205. In some examples, fuser assembly 200 can be in contact with roller 205 when in an operating state and/or in a non-operating state.

Fuser assembly 200 and roller 205 work in cooperative unison to respectively provide thermal energy for drying the media and provide pressure to smooth the media fibers. A force, as indicated by arrows "FF", can be applied independently by each fuser 204*a*, 204*b*, 204*c* toward roller 205. Each fuser 204*a*, 204*b*, 204*c* is independently moveably mounted within opening 106 to accommodate independent application of forces "FF". Forces "FF" can be applied normal, or perpendicular to, outer surface of roller 205. In one example, pressure applied by force "FF" can be independently controlled at each fuser 204*a*, 204*b*, 204*c*. Alternatively, force "FF" applies equal pressure at each roller 105. Regardless, force "FF" is evenly applied along a respective fuser 204*a*, 204*b*, 204*c*. Roller 205 can be compressively resilient and deflect as necessary in response to application of forces "FF" to provide consistent contact between roller 205 and heat elements 214 across each respective contact zone 234. Roller 205 can be cylindrical and rotatable in a clockwise or counter-clockwise (e.g., first or second direction) to assist in moving the media past fusion assembly 200 and through media conditioner 250. In one example, roller 205 rotate in a direction indicated by arrow 260 and belt 210 on fuser assembly 200 rotates in a direction indicated by arrow 262. Roller 205 has a length dimension measured along its cylindrical axis. In some examples, roller 205 and fuser housing 202 are substantially the same length.

Rollers 105, 205 can be positioned below, beside, or above fuser assemblies 100, 200, as long as respective rollers 105, 205 and respective array of fusers 104, 204 housed within fuser housing 102, 202 are disposed adjacently and within contact of one another. Fuser assemblies of the present disclosure, such as fuser assemblies 100, 200, can be utilized to restore a number of distorted properties of dried inkjet media to perform a finishing process. As described herein, the number of distorted properties of undried or partially dried inkjet media can cause problems when attempting to perform a finishing process.

Figure 4:
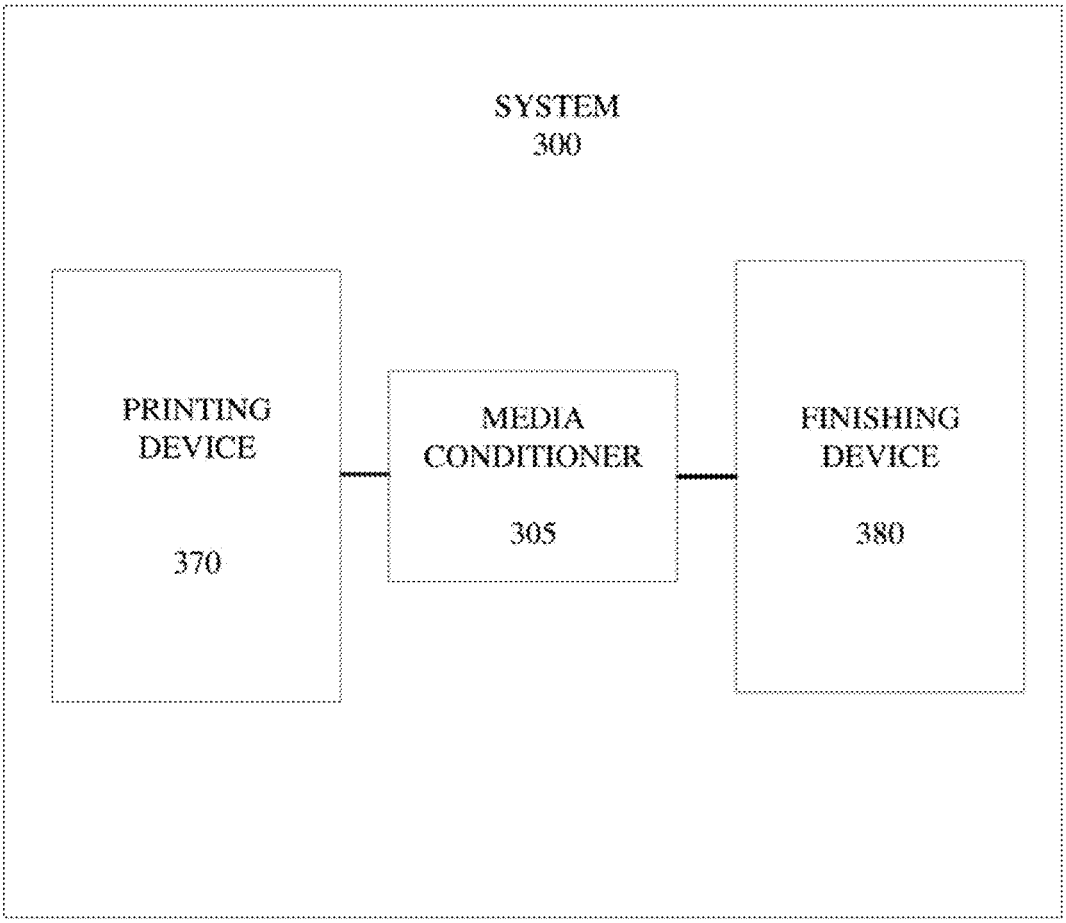
FIG. 4 is a schematic diagram of an example system including a media conditioner for use with a printing device and finishing device in accordance with aspects of the present disclosure.

FIG. 4 illustrates an example system 300 including a media conditioner 305 for use with a printing device 370 and a finishing device 380 in accordance with aspects of the present disclosure. In some examples, media conditioner 305 (including a fuser assembly such as fuser assembly 100 or fuser assembly 200) can be coupled between printing device 370 (e.g., inkjet printer, etc.) and finishing device 380 (e.g., finisher, etc.). For example, media conditioner 305 can provide dried flat inkjet media with reduced friction to finishing device 380 for performing finishing processes (e.g., stacking, collating, stapling, hole punching, binding, etc.). In other examples, media conditioner 305, and associated fuser assembly, can be included within either printing device 370 or finishing device 380. The resulting dried media is able to be used with finishers and other post print devices.

As described above, fusers assemblies 100, 200 can provide drying while the media is constrained, such as between rollers 105 and fuser housing 102, for example. Array of fusers 104, 204 can provide a multi-stage media conditioning (i.e., each fuser in array of fusers 104 creating a different stage of drying) allowing the printed media to progressively dry which helps stabilize the media's tendency to curl. Fusing also compresses the surface fibers thereby reducing surface friction. Array of fusers 104, 204 creates repetition of drying and surface compression. The repeated application of fusing yields progressive benefit towards a flat dry media sheet with a smooth surface.

Figure 5:
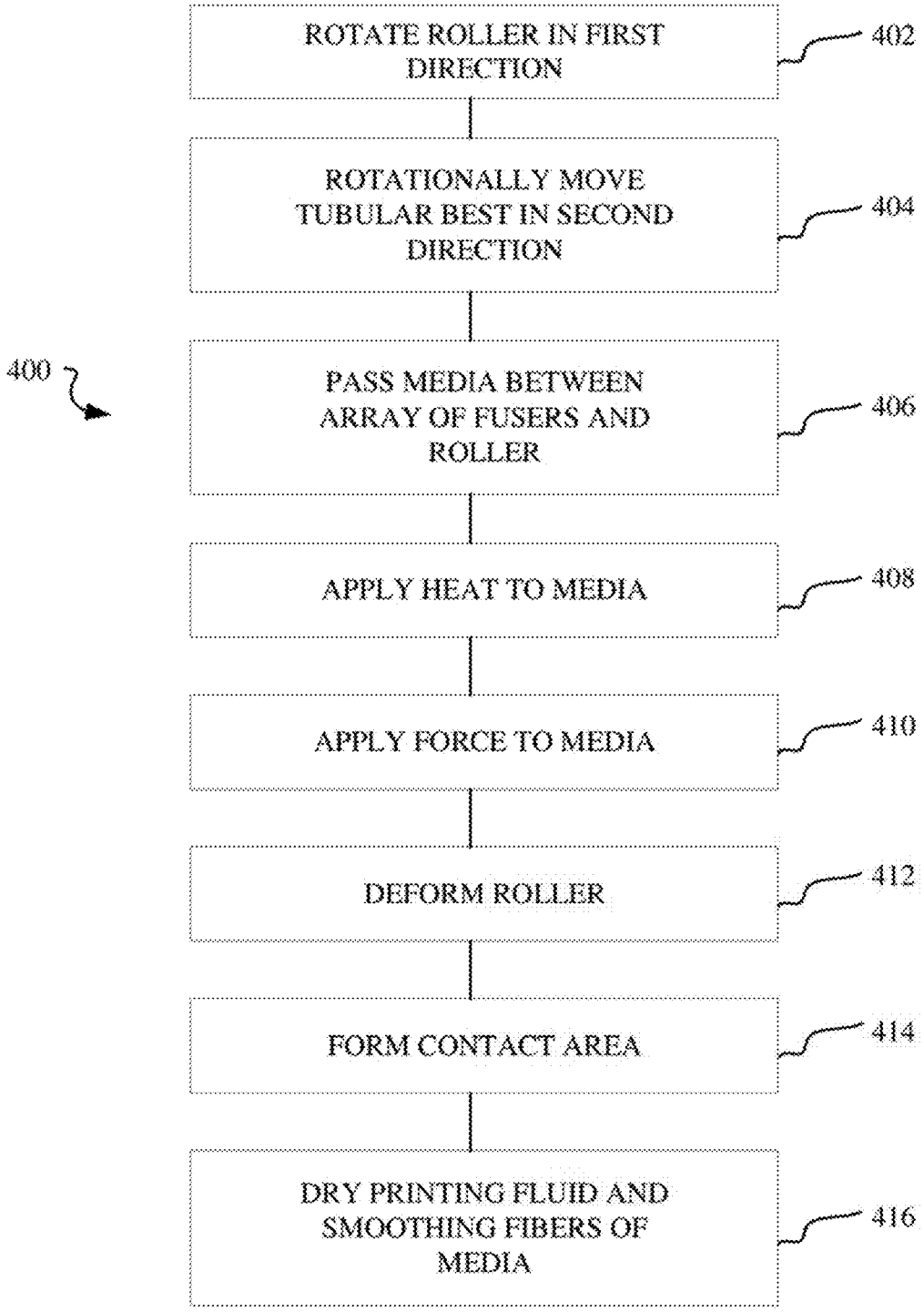
FIG. 5 is a flow diagram illustrating an example media conditioning method in accordance with aspects of the present disclosure.

FIG. 5 is a flow diagram illustrating a method 400 of conditioning media in accordance with aspect of the present disclosure. At 402, a roller is rotated in a first direction. At 404, a tubular belt is rotationally moved around an array of fusers disposed within a fuser housing. At 406, media is passed between the array of fusers and the roller. At 408, heat is applied from the array of fusers to the passing media. At 410, a force is applied to compress the media between the roller and the array of fusers. At 412, the roller is deformed against the array of fusers. At 414, a contact area is formed along each of the fusers in the array of fusers against the roller. At 416, a printing fluid applied to the media is dried and fibers of the media are smoothed.

Although specific examples have been illustrated and described herein, a variety of alternate and/or equivalent implementations may be substituted for the specific examples shown and described without departing from the scope of the present disclosure. This application is intended to cover any adaptations or variations of the specific examples discussed herein. Therefore, it is intended that this disclosure be limited only by the claims and the equivalents thereof.

The invention claimed is:

1. A fuser assembly to operate with a roller, comprising:
a fuser housing; and
an array of fusers, each fuser including a heating element exposed along a surface of the fuser housing and adjacent to an outer surface of the roller, wherein each respective fuser is to apply a force that is independent of a force applied by a remainder of the array of fusers.

2. The fuser assembly of claim 1, wherein each of the array of fusers comprises:
a metal housing contained within the fuser housing, the metal housing open along an outward side;
a plastic mount contained within the metal housing; and
a ceramic substrate attached to the plastic mount and exposed along the outward side;
wherein the heating element includes a resistive trace disposed on an outer surface of the ceramic substrate.

3. The fuser assembly of claim 1, wherein array of fusers extend along the fuser housing in spaced apart parallel rows.

4. The fuser assembly of claim 1, comprising:
a tubular belt disposed around the fuser housing, wherein the tubular belt is movable along a surface of the fuser housing and the array of fusers.

5. The fuser assembly of claim 1, wherein each of the array of fusers is moveably disposed within the fuser housing to independently apply a normal force on the roller.

6. The fuser assembly of claim 1, wherein the array of fusers is fixedly disposed within the fuser housing.

7. The fuser assembly of claim 1, wherein the housing comprises plastic.

8. A media conditioner to operate with a printing apparatus, comprising:
a roller;
a fuser housing disposed parallel to the roller; and
an array of fusers disposed in the fuser housing, each of the array of fusers including a heating element exposed along a surface of the housing, each respective fuser is to apply a force that is independent of a force applied by a remainder of the array of fusers, wherein each of the array of fusers defines a contact zone disposed adjacent the roller, and wherein the contact zone provides at least one of drying of printing fluid and smoothing fibers of a media.

9. The media conditioner of claim 8, wherein the fuser housing is curved to correspond to the radius of the roller and position each of the array of fusers against the outer surface of the roller.

10. The media conditioner of claim 8, comprising:

an array of rollers, and wherein the fuser housing positions each of the array of fusers adjacent to a respective one of the array of rollers.

11. The media conditioner of claim 8, wherein the fusers are movably mounted within the housing to apply a normal compressive force against the roller.

12. A method of conditioning media, comprising:

rotating a roller in a first direction;

rotationally moving a tubular belt in a second direction around an array of fusers disposed within a fuser housing;

passing media between the array of fusers and the roller;

applying heat from the array of fusers to the passing media;

applying a force to compress the media between the roller and the array of fusers, wherein each respective fuser is to apply a force that is independent of a force applied by a remainder of the array of fusers;

deforming the roller against the array of fusers;

forming a contact area along each of the fusers in the array of fusers against the roller; and drying a printing fluid applied to the media and smoothing fibers of the media.

13. The method of claim 12, wherein each of the array of fusers includes resistor traces for applying heat.

14. The method of claim 12, wherein applying the force includes each of the array of fusers applying a normal force toward the roller, and wherein the fuser housing is stationary.

15. The method of claim 12, wherein applying the force includes the roller and at least one additional roller applying a normal force toward the array of fusers.

16. The fuser assembly of claim 1, wherein each fuser among the array of fusers includes:

a first heating element exposed at a first end of the respective opening and adjacent to the outer surface of the roller; and a second heating element exposed at a second end of the respective opening opposite the first end and adjacent to the outer surface of the roller.

17. The fuser assembly of claim 1, wherein the heating element includes a conductive wire disposed on a substrate and extending in a plurality of rows along a length of the respective fuser.

18. The method of claim 12, wherein applying heat from the array of fusers to the passing media includes separately controlling heating elements on the array of fusers.

19. The method of claim 12, wherein applying heat from the array of fusers to the passing media includes delivering a graduated heat level among the array of fusers.

* * * * *